US006466676B2

(12) United States Patent
Coffin

(10) Patent No.: US 6,466,676 B2
(45) Date of Patent: Oct. 15, 2002

(54) COMPOUND DRIVER FOR ACOUSTICAL APPLICATIONS

(76) Inventor: C. Ronald Coffin, 18 John's La., Topsfield, MA (US) 01983

( * ) Notice: Subject to any disclaimer, the term of this patent is extended or adjusted under 35 U.S.C. 154(b) by 0 days.

(21) Appl. No.: 09/779,279

(22) Filed: Feb. 8, 2001

(65) Prior Publication Data

US 2001/0033668 A1 Oct. 25, 2001

Related U.S. Application Data

(60) Provisional application No. 60/181,181, filed on Feb. 9, 2000.

(51) Int. Cl.[7] ..... H04R 25/00

(52) U.S. Cl. ..... 381/186; 381/184

(58) Field of Search ..... 381/424, 186, 381/185, 184, 182, 412; 181/163, 161, 147

(56) References Cited

U.S. PATENT DOCUMENTS

| | | | | |
|---|---|---|---|---|
| 1,545,718 | A | 7/1925 | Williams | |
| 1,667,251 | A | 4/1928 | Fay et al. | |
| 1,674,895 | A | 6/1928 | Fay et al. | |
| 1,815,987 | A | 7/1931 | Peterson | |
| 1,876,831 | A | 9/1932 | Ballantine | |
| 1,932,459 | A | 10/1933 | Harris | 179/116 |
| 2,231,479 | A | 2/1941 | Perry | 179/115.5 |
| 2,278,598 | A | 4/1942 | Turney | 176/115.5 |
| 2,295,527 | A | 9/1942 | Bowley | 179/116 |
| 2,553,539 | A | 5/1951 | Bauer | 179/139 |
| 3,116,377 | A | 12/1963 | Todt | 179/115 |
| 3,350,514 | A | 10/1967 | Cooke | 179/115.5 |
| 3,573,396 | A | 4/1971 | Schoengold | 179/115 |
| 3,772,466 | A | 11/1973 | Hossbach | 179/116 |
| 4,134,471 | A | 1/1979 | Queen | 181/147 |
| 4,146,756 | A | 3/1979 | Kito et al. | 179/115.5 |
| 4,301,332 | A | 11/1981 | Dusanek | 179/1 |
| 4,477,699 | A | 10/1984 | Wada et al. | 179/116 |
| 4,497,981 | A | 2/1985 | House | 179/115.5 |
| 4,590,332 | A | 5/1986 | Delbuck | 179/115.5 |
| 4,595,801 | A | 6/1986 | Coffin | 179/115.5 |
| 4,821,330 | A | 4/1989 | Pfleiderer | 381/184 |
| 4,845,776 | A | 7/1989 | Bittencourt | 381/190 |
| 4,942,939 | A | 7/1990 | Harrison | 381/195 |
| 4,965,839 | A | 10/1990 | Elieli | 381/195 |
| 4,996,713 | A | 2/1991 | Bittencourt | 381/190 |
| 5,177,329 | A | 1/1993 | Klayman | 181/156 |
| 5,295,194 | A | 3/1994 | Christensen | 381/192 |
| 5,418,860 | A | 5/1995 | Daniels | 381/194 |
| 5,548,657 | A | 8/1996 | Fincham | 381/182 |
| 5,550,332 | A | 8/1996 | Sakamoto | 181/148 |
| 5,621,804 | A | 4/1997 | Beppu | 381/90 |
| 5,714,722 | A | 2/1998 | Noponen | 181/173 |
| 5,822,444 | A | 10/1998 | Oizumi et al. | 381/405 |

FOREIGN PATENT DOCUMENTS

| | | |
|---|---|---|
| EP | 0771133 | 5/1997 |

*Primary Examiner*—Sinh Tran
(74) *Attorney, Agent, or Firm*—George A. Herbster

(57) ABSTRACT

A compound driver acoustic transducer. A frame supports a motion generator to one side of two diaphragms. An intermediate diaphragm is continuous and is driven by the motion generator. The intermediate diaphragm forms a closed volume with a solid portion of the frame that opens into a central opening through the other, open diaphragm. An axially rigid coupling connects the two diaphragms so they operate in unison.

21 Claims, 5 Drawing Sheets

COMPOUND DRIVER FOR ACOUSTICAL APPLICATIONS

This application cation claims the benefit provisional application 60/181,181 filed Feb. 9, 2000.

BACKGROUND OF THE INVENTION

1. Field of the Invention

This invention generally relates to acoustical transducers and more particularly to acoustical loudspeakers with improved performance characteristics.

2. Description of Related Art

My U.S. Pat. No. 4,595,801 discloses a dual cone loudspeaker with a primary speaker cone similar in function to a conventional dynamic loudspeaker mounted on a frame with a magnet structure. A secondary speaker cone mounts to a subframe on the back of the magnet structure and connects to the primary speaker cone through a rigid coupling device so the primary and secondary speaker cones move in unison. Sound waves from the secondary speaker cone travel through an orifice in a center pole piece of the magnet structure and through a hole in the center of the primary speaker cone radiating in the same direction as sound waves from the primary speaker cone. Consequently for a given excursion of the primary speaker cone my dual cone structure generates a greater sound volume than the primary cone alone by virtue of the simultaneous excursions of both the primary and secondary speaker cones that move a greater air volume for a given speaker cone displacement. As a result this dual-cone loudspeaker is a compound driver or compound acoustic transducer.

More specifically, the compound driver disclosed in my patent includes a primary speaker cone with a frusto-conical form with the center removed that attaches to a bobbin that carries a voice coil. The rigid coupling device includes a center link with radial spokes. The radially outer end of each spoke attaches directly to the secondary speaker cone at the voice coil bobbin.

My U.S. Pat. No. (Ser. No. 09/251,815) filed Feb. 17, 1999 discloses improvements wherein a cylindrical structure attaches to the radially outer end of each spoke and provides a rigid bonding ring that attaches to the voice coil with increased reliability. The entire support structure has an open form and is located centrally of the voice coil. It includes a rigid link that connects to the second speaker cone to produce in the second speaker cone motion corresponding to the voice coil and the first speaker cone.

It has been found that in certain applications, the compound driver described above may be limited in effectiveness by certain aspects of the design. Specifically, the secondary cone drives air through an orifice defined by a vent through the central pole piece of a conventional magnet structure. The size of commercially available voice coils and ring magnets constrains the size of this vent and also limits the ability to construct compound drivers having a large size. Additionally, since the vent has a finite axial length through the magnet, the vent can have the effect of a port. This effect in conjunction with the volume of the compression chamber may create a resonance in certain acoustic applications that could limit the effective bandwidth of the compound driver. Further the spacing between the two loudspeaker cones, controlled by the depth of the magnet structure, may introduce phase cancellation at certain frequencies thereby also limiting bandwidth.

SUMMARY

Therefore it is an object of this invention to provide an improved compound driver, particularly in the form of an acoustic transducer such as dual-cone loudspeaker.

It is another object of this invention to provide an improved compound driver, particularly in the form of an acoustic transducer such as dual-cone loudspeaker, that exhibits an improved frequency response.

Still another object of this invention to provide an improved compound driver, particularly in the form of an acoustic transducer such as dual-cone loudspeaker, that minimizes the possibility of phase cancellation.

Yet another object of this invention to provide an improved compound driver, particularly in the form of an acoustic transducer such as dual-cone loudspeaker, that minimizes resonant frequencies over the normal operating frequency range.

In accordance with this invention, an acoustic transducer for generating acoustic waves along a transducer axis includes a frame, a motion generator and open and continuous diaphragms. The frame extends along a transducer axis and has a central opening on the axis. The motion generator connects to the frame and produces an oscillatory output motion along the transducer axis. The open diaphragm has an outer periphery and an inner periphery that defines a central opening on the transducer axis and axially proximate the central frame opening. First and second flexible couplings attach the open diaphragm inner and outer peripheries to the frame generally transverse to the transducer axis and spaced from the motion generator. The continuous diaphragm has an outer periphery, and a third flexible coupling attaches the continuous diaphragm outer periphery to the frame generally transverse to the transducer axis and intermediate of and spaced from the open diaphragm and the motion generator. The continuous diaphragm attaches to the motion generator, and an axially rigid coupling attaches between the continuous and open diaphragms whereby motion of the continuous diaphragm produced by the motion generator produces corresponding motion of the open diaphragm and whereby air intermediate the diaphragms displaced by the continuous diaphragm moves through the central opening of the open diaphragm.

In accordance with another aspect of this invention, a loudspeaker for generating acoustic waves along a speaker axis includes a frame, a magnetic structure with a voice coil and voice coil bobbin, annular and continuous diaphragms and an axially rigid coupling. The frame extends along the loudspeaker axis with a central opening located on the axis. The magnetic structure connects to the frame and includes a magnet that defines an air gap for receiving the voice coil and bobbin whereby electrical signals applied to the voice coil produce oscillatory motion of the voice coil and bobbin in the air gap along the loudspeaker axis. The annular diaphragm has an outer periphery and has an inner periphery that defines a central opening on the axis and axially proximate the central frame opening, and first and second flexible couplings circumscribing the annular diaphragm inner and outer peripheries attach to the frame to position the annular diaphragm transversely to the loudspeaker axis and spaced from the magnet structure. The continuous diaphragm has an outer periphery, and a third flexible coupling circumscribing the continuous diaphragm outer periphery attaches to the frame to position the continuous diaphragm transversely to the loudspeaker axis and intermediate of and spaced from the annular diaphragm and the magnet structure. The continuous diaphragm connects to the bobbin. The axially rigid coupling connects between the continuous and annular diaphragms whereby motion of the continuous diaphragm produced by the bobbin produces corresponding motion of the annular diaphragm and whereby air intermediate the diaphragms displaced by the continuous diaphragm moves through the central opening of the annular diaphragm.

In accordance with yet another aspect of this invention a loudspeaker comprises a frame having a magnetic structure with an air gap and a voice coil for oscillating on a speaker axis through the air gap in response to electrical signals. A first, annular speaker cone has inner and outer peripheries that attach to the frame to be spaced from the magnetic structure. A second speaker cone has an outer periphery that attaches to the frame intermediate and spaced from each of the magnetic structure and the first speaker cone. An axially rigid coupling connects to the spaced first and second speaker cones and to the voice coil whereby oscillation of the voice coil along the speaker axis produces corresponding motion of the first and second speaker cones.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
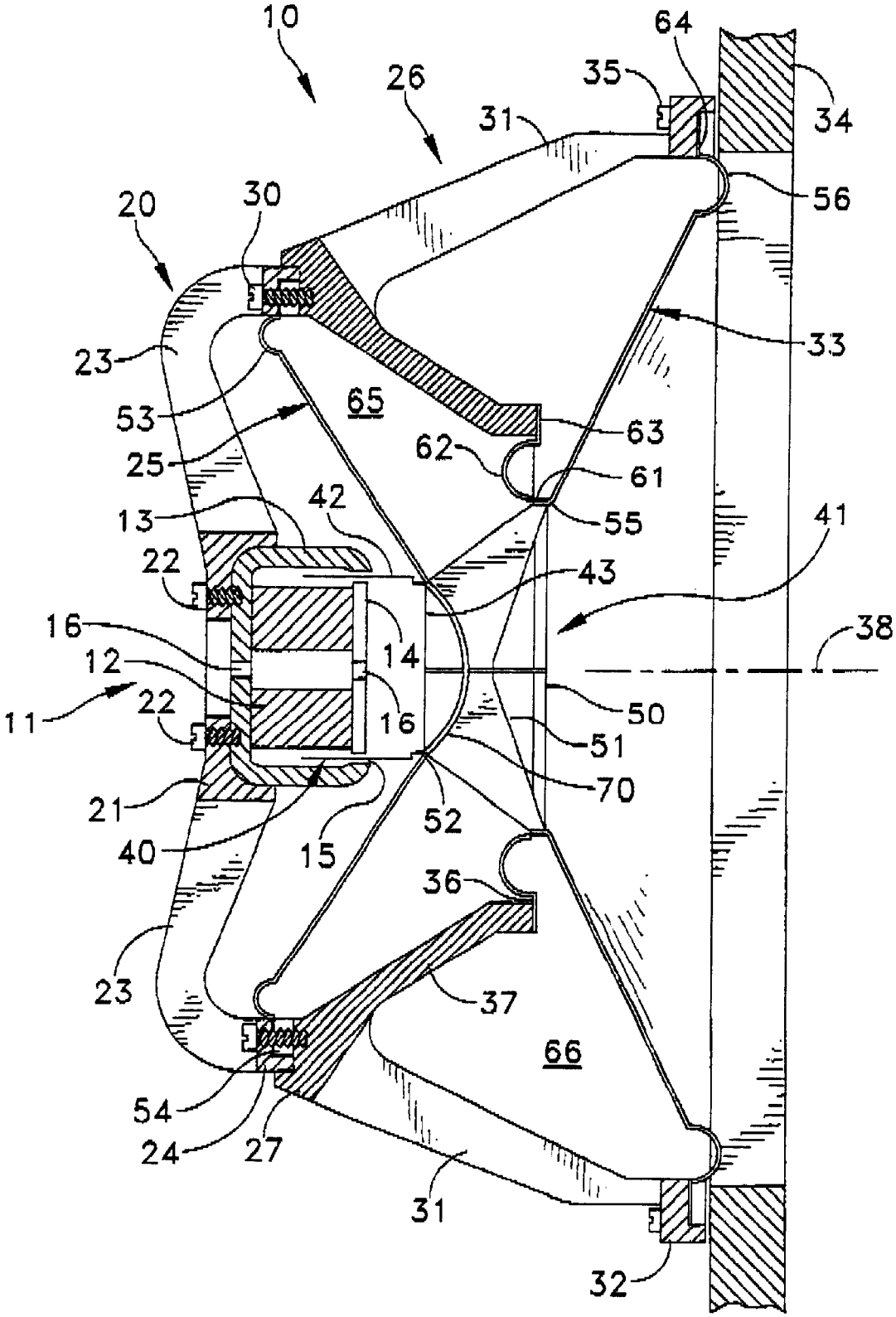
FIG. 1 is a section view, in schematic form, of one embodiment of a compound driver according to this invention in the form of a dual cone loudspeaker.

For purposes of explaining and understanding this invention, FIG. 1 depicts a dual cone loudspeaker 10 with a number of structures including a magnet structure 11. The magnet structure 11 includes a permanent magnet 12 that may be formed of discrete magnets or a single magnet. The permanent magnet extends between pole pieces 13 and 14 to form a magnetic air gap 15. An optional vent 16 provides an air passage through the magnet structure 11.

A motor support frame 20 carries the magnet structure. The motor support frame 20 includes an annular center support 21 that seats the magnet structure 11. Bolts 22 or other fasteners attach the magnet structure 11 to the annular center support 21. The annular center support 21 additionally carries a plurality of angularly spaced, radially extending arms 23 that carry an outer annular support ring 24. The outer support ring 24 clamps a compression cone 25 to a front support frame 26.

The front support frame 26 includes an inner annular base 27 that attaches to the annular ring 24 by angularly spaced bolts 30 or other fasteners. The inner annular base 27 carries a plurality of angularly spaced, radially extending arms 31 that terminate at an outer, annular support 32. The outer annular support 32 carries the outer periphery of a primary or direct radiating cone 33. The outer annular support 32 also provides a means for mounting the entire speaker to a plate 34, such as the wall of a speaker enclosure. Fasteners 35 affix the outer, annular support 32 to the plate 34.

The frame support 26 also includes an intermediate mounting surface 36 formed at the end of a frusto-conical structure 37 extending from the base 27 centrally of the arms 31. The frusto-conical structure 37 forms a radially, extending annular surface lying in a transverse plane to a speaker axis 38.

The magnet structure 11, the motor support frame 20 and front support frame 26 form a stationary structure for the loudspeaker 10. The remaining structure shown in FIG. 1 depicts the moving structure. This moving structure includes the primary or direct radiating loudspeaker cone 33, the secondary or compression loudspeaker cone 25, a voice coil 40 and a drive link 41.

The voice coil 40 is shown schematically as including a cylindrical support or bobbin 42 that extends through the magnetic air gap 15. As known in the art, electrical conductors convey audio signals to the voice coil 40 thereby to produce the interaction with the magnetic field that displaces the voice coil 40 and bobbin 42 at a frequency corresponding to the signal frequency. The voice coil 40 and bobbin 42 generally are formed as an open cylinder.

The drive link 41 includes an annular ring 50 and an open web structure 51 that attaches to the voice coil 40 at a junction 52 about the periphery of the voice coil bobbin 42. A number of possible connection methods can be used. Compression cone 25 also extends from the junction 52 and is supported thereby. At the outer periphery, the compression cone 25 terminates in a surround 53 with a flange that attaches to the outer annular structure 27 of the front support frame 26. A gasket 54 or other device can be included to assure that the surround 53 seats firmly between the outer annular ring 24 and the annular support ring 27.

The annular ring 50 attaches to an inner periphery 55 of the direct radiating cone 33 at a central opening. An inner periphery 61 of an annular surround 62 attaches to the direct radiating cone 33 at the periphery 55. A outer flange 63 of the surround 62 attaches to the annular intermediate mounting surface 36. A flange 64 at the outer periphery of the surround 56 attaches to the outer peripheral support 32. This structure isolates any air flow from a variable volume chamber 65, defined in part by the compression cone 25 and the frusto-conical structure 37, from interacting with air in an open volume 66 bounded, in part, by the frusto-conical structure 37 and the direct radiating cone 33. That is, air moving as a result of oscillations of the compression cone 25 moves through the opening defined by the ring 50 independently of air in the open volume 66.

As will now be apparent, motion of the voice coil 40 drives both the direct radiating cone 33 and compression cone 25 in a unitary fashion. Outward motion, motion to the right in FIG. 1, produces an air flow generated by the front facing surfaces of both the direct radiating cone 33 and the compression cone 25. In this configuration, it will be apparent that there is only a minimal axial distance between the direct radiating cone 33 and compression cone 25. This feature raises the frequency at which the possibility of phase cancellation could otherwise occur if the speaker cones were more widely axially spaced.

Secondly, placing the compression cone 25 on the same side of the magnet structure as the direct radiating cone 33 improves air flow with respect to the loudspeaker 10. That is, air drawn by the compression cone 25 only flows through the open web structure 51. It does not flow through the magnet structure as would occur if the magnet structure were intermediate the compression cone 25 and the direct radiating cone 33.

This structure has the additional advantage of allowing a high frequency radiating dome to be attached directly to the voice coil 40. In this particular embodiment a dome-shaped, high frequency radiator 70 spans an open end of the voice coil 40 attaching peripherally to the voice coil 40 and the compression cone 25 at 52. This structure is responsive to high frequency signals and extends the frequency range of the loudspeaker. It also provides structural stability to the voice coil 40 and bobbin 42 and is an integral element in the drive link 41.

A loudspeaker as shown in U.S. Pat. No. 4,595,801, has an exposed magnetic air gap. This air gap is subject to contamination by the accumulation of dust. The structure shown in FIG. 1 minimizes any such accumulation by isolating the magnetic air gap 15 from the air flow path between the direct radiation and compression cones 33 and 25. More specifically, dust that would accumulate in the magnetic structure generally would travel through the opening in the front panel 34. With this structure, however, the direct radiating cone 33, compression cone 25 and high frequency radiator 70 are barriers that block any transfer of dust into the magnet structure.

As another advantage, this structure simplifies the manufacture of a dual cone loudspeaker or compound acoustic transducer. More specifically, it is possible to construct one subassembly of the compression cone 25 with its surround 53, the voice coil 40 and bobbin 42, the drive link 41 and the rear motor support frame 20 with the magnet structure 11. A second subassembly includes the front support frame 26 and the direct radiating cone 33 with its surrounds 56 and 62. The loudspeaker is assembled by attaching the rear motor support frame 20 with bolts 30. Then an adhesive is applied to the ring 50 to bond it to the inner periphery 55 of the direct radiating cone 33.

Figure 2:
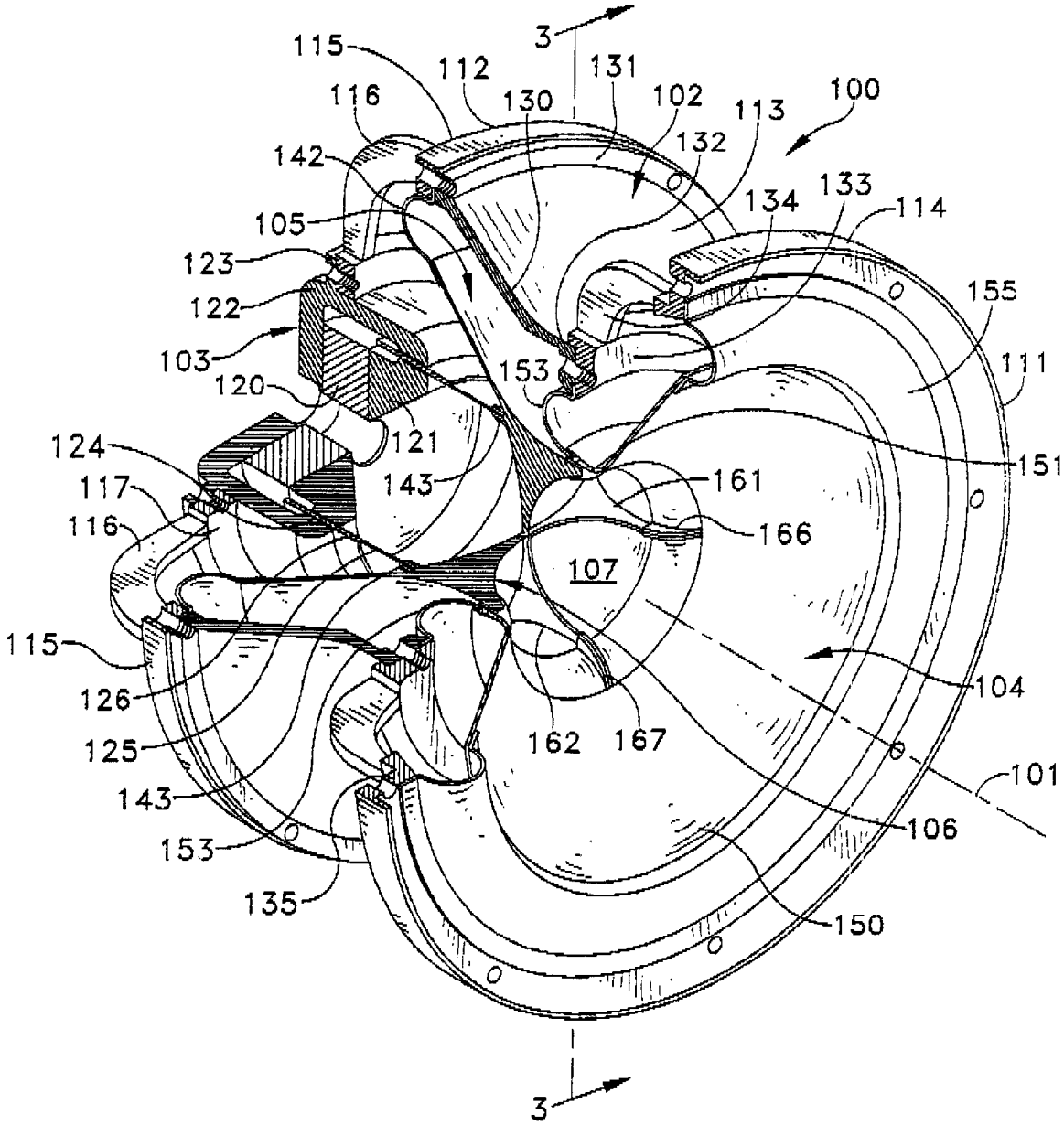
FIG. 2 is a perspective view of a preferred loudspeaker embodiment of this invention.
Figure 3:
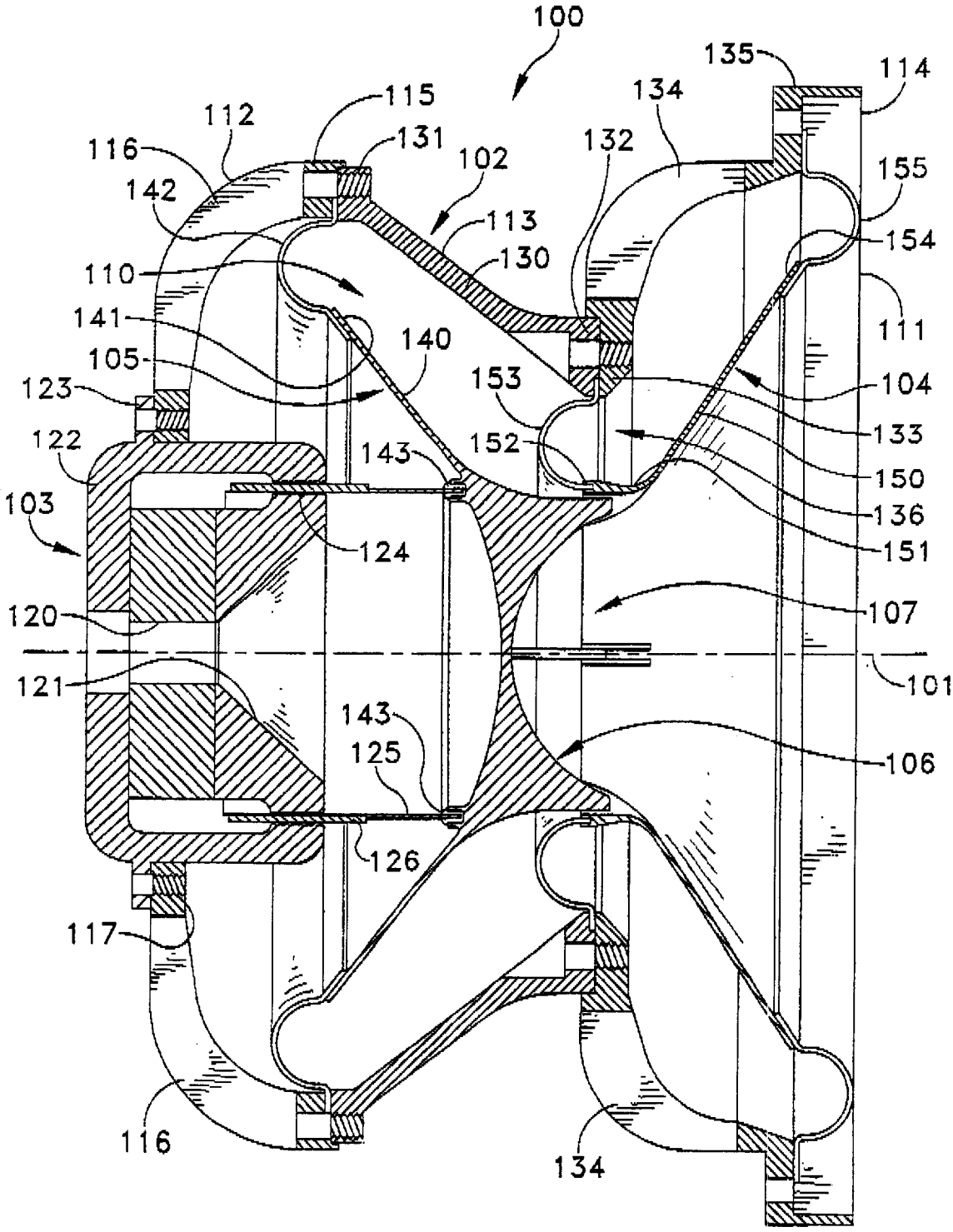
FIG. 3 is a cross-sectional view through the speaker of FIG. 2.
Figure 4:
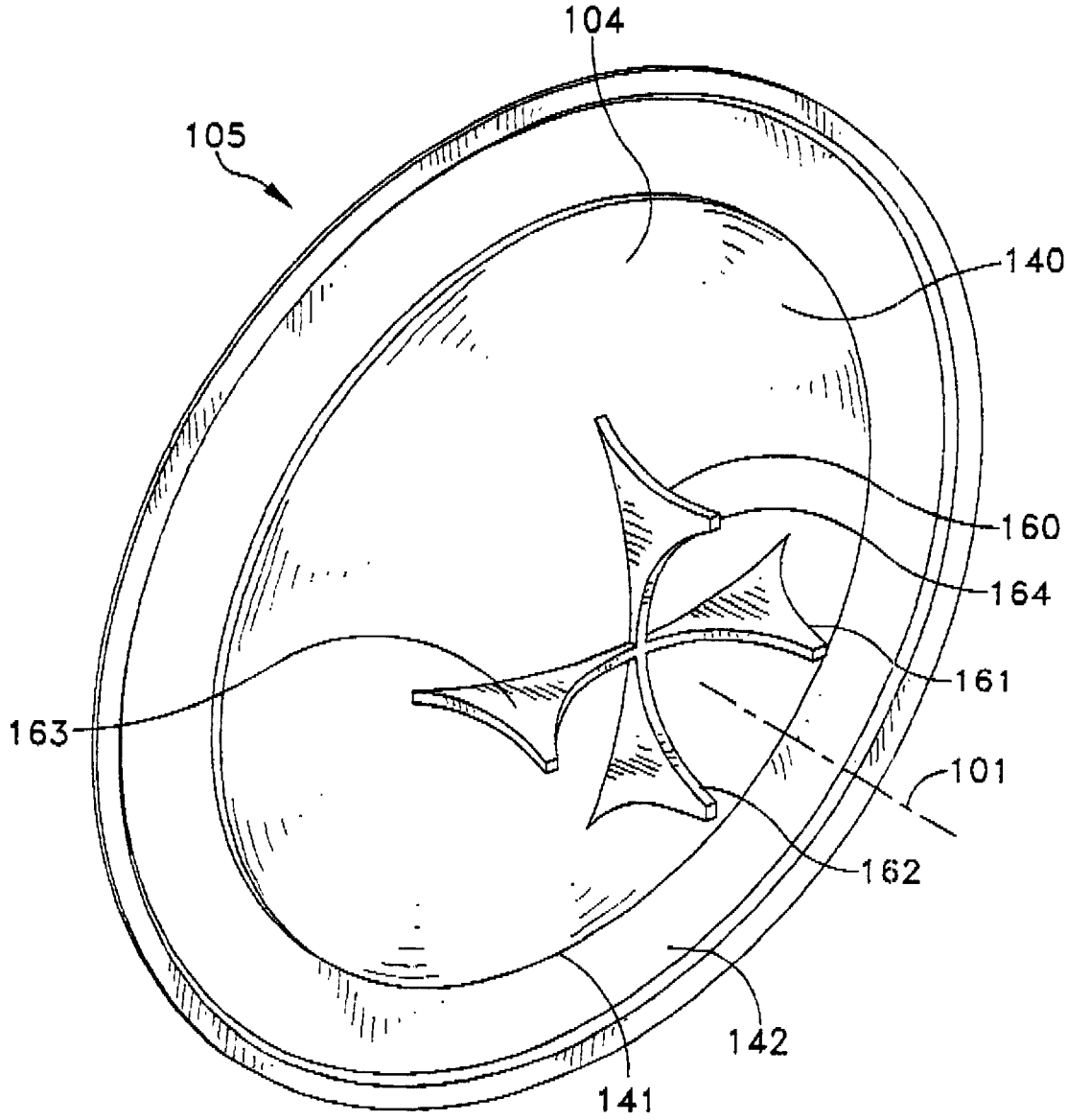
FIG. 4 is a perspective view of a diaphragm used in the embodiment of FIG. 2.

FIGS. 2 through 5 depict an improved compound driver structure that can act as a variety of acoustic transducers including a loudspeaker that is shown. As will become evident, this acoustic transducer exhibits all the performance characteristics and provides all of the advantages of the loudspeaker 10 shown in FIG. 1. Specifically, FIGS. 2 and 3 depict a compound acoustic transducer in the form of a dual-cone or compound loudspeaker 100 that generates acoustic waves along a transducer or a loudspeaker axis 101. An axially extending frame 102 carries a motion generator 103 at one end. The motion generator 103 produces an oscillatory mechanical output motion along the axis 101. The frame 102 also carries a first diaphragm 104 and a second diaphragm 105. The second diaphragm 105 is intermediate of and spaced from both of the motion generator 103 and first diaphragm 104. An axially rigid coupling 106 extends between the first and second diaphragms 104 and 105. Consequently the motion generator 103 moves the second diaphragm 105, and the axially rigid coupling 106 produces a corresponding motion in the first diaphragm 104. The first diaphragm 104 has a central opening 107 formed about the axis 101. In the following discussion, the first diaphragm 104 is called an "open" diaphragm. There is no opening through the second diaphragm 105, so it is called a "continuous" diaphragm.

The continuous diaphragm 105 is spaced from a solid section of the frame 102 to define a closed volume 110 that opens into the central opening 107 like the volume 65 in FIG. 1. Consequently, during oscillations of the continuous diaphragm 105, air moves into and out of the variable volume 110 through the central opening 107, so air from the volume 110 combines with air that the open diaphragm 104 displaces.

With this general understanding, it will be possible to appreciate some of the advantages of this acoustic transducer. First, the central opening 107 has an extremely short length along the axis 101. Although any restricted air passage can be characterized as a port, an analysis of the central opening 107 determines that any resonance introduced by the central opening 107 acting as a port will be outside the normal operating range and will not adversely effect loudspeaker frequency response.

In this embodiment the axial spacing between the open diaphragm 104 and continuous diaphragm 105, like the spacing between the compression cone 25 and the direct radiating cone 33 in FIG. 1, is significantly decreased over the axial spacing in the prior acoustic transducer of U.S. Pat. No. 4,595,801 because the motion generator 103 mounts to one side of both diaphragms 104 and 105. Consequently, and as previously indicated, the frequency at which the possibility of detectible phase cancellation exists increases over the corresponding frequency in the prior dual cone loudspeaker.

This foregoing basic description of the construction and operation of acoustic transducers constructed in accordance with this invention will facilitate an understanding of a specific embodiment of an acoustic transducer in terms of the loudspeaker 100 as shown in FIGS. 2 through 5. The frame 102, shown most clearly in FIGS. 2 and 3, has a generally circular shape that is centered on the axis 101. It comprises a rear frame member 112, an intermediate frame member 113 and a front frame member 114 extending along the axis 101. Each frame member is generally transverse to the axis 101 and, in this specific embodiment, a plane through any common frame member surface, such as the front surface 111, lies in a plane normal to the axis 101 although this is not a requirement. Furthermore each of the frame members has a generally annular or circular shape because diaphragms, like the diaphragms 104 and 105, generally have a circular shape. However, as will be apparent, nothing prevents this invention from being applied to acoustic transducers with other diaphragm and frame shapes.

The rear frame member 112 includes a continuous annular flange 115 and a plurality of L-shaped radial arms 116. Four equiangularly spaced radial arms are shown by way of example. The arms 116 terminate in a rear central flange 117 to form a cup-shaped rear frame member 112 that carries the motion generator 103. For the particularly disclosed loudspeaker application, the motion generator 103 can be any type of mechanical or electro-mechanical transducer that produces a mechanical oscillating output motion along the axis 101. In this embodiment, it is an electromechanical transducer that includes an annular magnet 120, an annular inner pole piece 121 and a cup-shaped outer pole piece 122. An integral flange 123 attaches the pole piece 122 to the flange 117 by fasteners, not shown, such as machine screws or the like. The pole pieces 121 and 122 form an annular air gap 124 intermediate the flange 123 and the continuous diaphragm 105. A voice coil bobbin 125 carries a voice coil 126 in the air gap 124. The bobbin 125 is supported, as described later, so that upon the application of AC signal to the voice coil 126, the bobbin 125 and voice coil 126 oscillate along the axis 101 with a frequency and displacement that the frequency and amplitude of the AC signal determine.

The intermediate frame member 113 preferably has a solid frusto-conical body 130 with an outer or maximum diameter flange 131 attached to the flange 115 on the rear frame member 112. A minimum diameter flange 132 at the other end of the body 131 attaches to a flange 133 on the front frame member 114. The flange 133 carries a plurality of angularly spaced, L-shaped, radially extending arms 134 that terminate at an outer continuous annular flange 135 that is axially displaced from the flange 133. The flanges 132 and 133 define a frame opening 136.

The intermediate frame member 113 supports and carries the continuous diaphragm 105 that, in this particular embodiment, has a generally dome-shaped solid body 140 with an outer periphery 141 and acts as a speaker cone in this loudspeaker application. A surround 142 attaches the peripheral edge 141 to the frame 100 and constitutes a flexible coupling that circumscribes the periphery 141. In this particular embodiment, the flanges 115 and 132 clamp an outer peripheral portion of the surround 116.

The solid body 140 also attaches to the output of the motion generator 103. In this particular embodiment a continuous annular channel 143 is formed on the side of the solid body 140 facing the motion generator 103 as shown in FIGS. 2 and 3. The channel 143 lies on the axis 101 and registers with the voice coil bobbin 125, so the free end of the voice coil bobbin 125 lies in the channel 143. An epoxy or other adhesive fills the channel 143 to produce a strong, lightweight, reliable attachment that withstands the stresses introduced during operation of the loudspeaker. As will now be apparent, as the voice bobbin 125 oscillates along the axis 101 in response to signals applied to the voice coil 126, the solid body 140 moves with the bobbin 125 and that motion is decoupled from the frame by the surround 142.

The open diaphragm 104 or annular speaker cone has an annular body 150 centered on the loudspeaker axis 101. A curved inner portion 151 terminates at an inner periphery or edge 152 proximate the frame opening 136. A surround 153 attaches to the inner periphery 152. The flanges 133 and 135 capture the outer edge of the surround 153. Similarly, an outer periphery or edge 154 attaches to a surround 155. An outer edge of the surround 155 attaches to the annular flange 135 thereby to support and carry the open diaphragm 104 in the frame 102. As will be apparent, the surrounds 153 and 155 also constitute flexible couplings that support the open diaphragm 104 and decouple the open diaphragm 104 from the frame member 114, so the open diaphragm 104 is enabled to move freely in response to displacements of the continuous diaphragm 105 and the axially rigid coupling 106.

The axially rigid coupling 106 spans the distance between the continuous diaphragm 105 and annular diaphragm 104. As particularly shown in FIG. 4, the solid body 140 forms a continuous surface and in this particular embodiment the diaphragm 105 has integrally molded elements that form portions of the axially rigid coupling 106. In other embodiments an axially rigid coupling might be attached to an insert in the surface. In this particular embodiment, the axially rigid coupling 106 includes a plurality of angularly spaced, axially extending thin arms 160, 161, 162 and 163. Each arm extends from the surface of the solid body 140 to an axially directed tip, such as the axially directed tip 164 associated with the arm 160.

Figure 5:
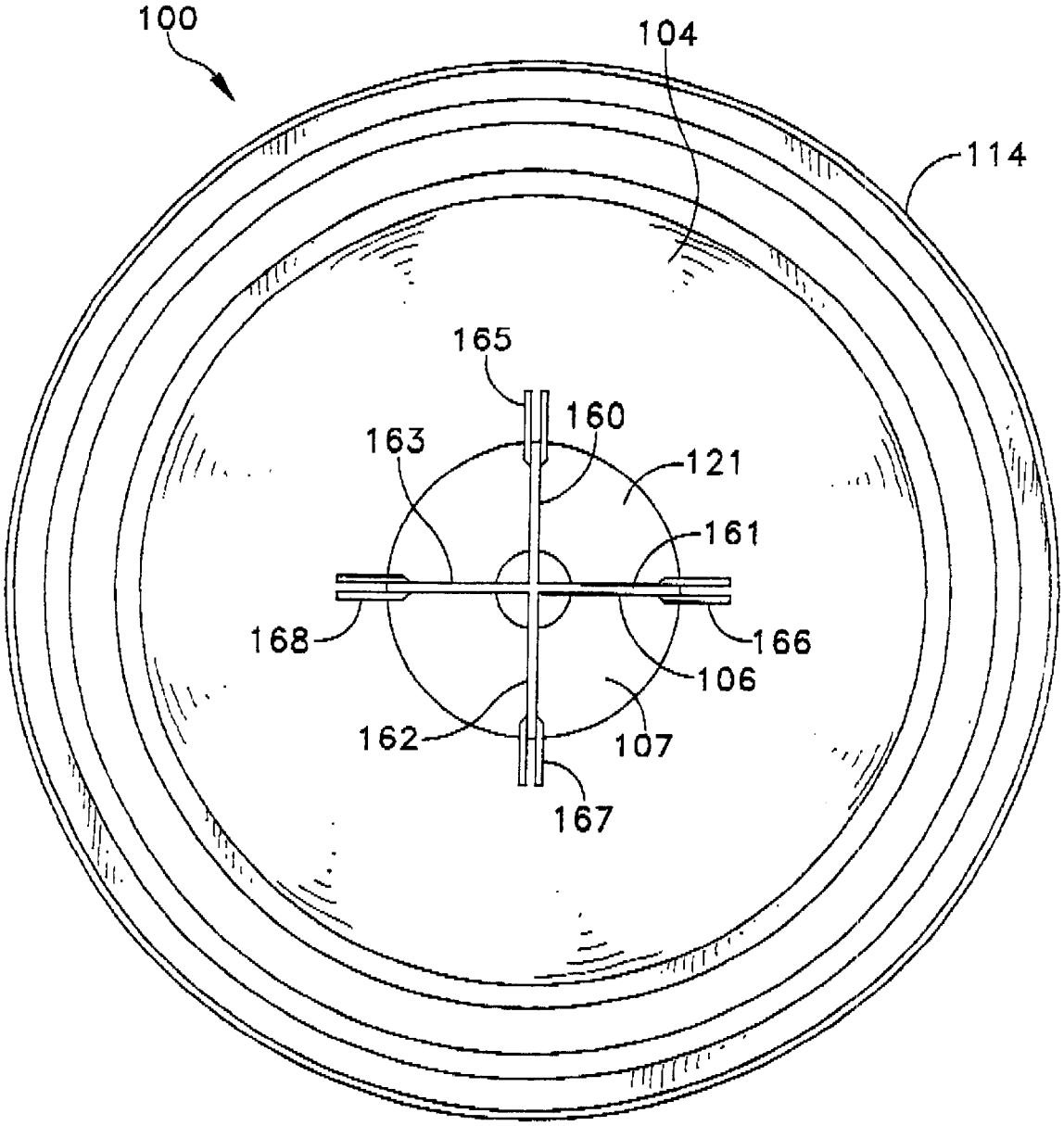
FIG. 5 is a front plan view of the loudspeaker shown in FIG. 2.

Now referring to FIGS. 2 and 5, the inner peripheral portion of the annular diaphragm 104 includes a plurality of axially extending, angularly spaced channel members 165, 166, 167 and 168. Each channel member receives an area adjacent the tip of a correspondingly located one of the arms 160, 161, 162 and 163, respectively. During manufacture an epoxy or other adhesive affixes the tip portion of each of the radial arms in the corresponding channel in a secure, reliable connection. As will be more apparent from FIG. 5, the axially extending rigid link 106 has only a small area in a section normal to the axis 101. Consequently, this structure maintains a low impedance air passage through the annular diaphragm 104 for air flow from the continuous diaphragm 105 and the variable volume 110.

Thus as previously indicated when an AC signal energizes the voice coil 126, the bobbin 125 oscillates along the axis 101 and moves the rear or continuous diaphragm 105 in an oscillatory motion. The axially extending rigid coupling 106 transfers that motion to the open diaphragm 104 that acts as a front speaker cone. When forward motion (i.e., to the right in FIG. 4) causes the continuous diaphragm to compress the variable volume 110, air is driven out of the variable volume 110 through the central opening 107. Conversely, when the variable volume 110 expands, air moves into the variable volume 110 through the central opening 107. As the rigid coupling 106 produces no significant impedance to that air flow and as the central opening 107 introduces no measurable effects as a port, any resonances that might exist occur at frequencies well above the operating frequency range for the compound acoustic transducer or driver, especially in a loudspeaker application for operating in the audio frequency band.

The specific structure shown in FIGS. 2 and 3 also facilitates the assembly of a loudspeaker. In one subassembly process the rear frame 112 and motion generator 103 with the voice coil bobbin 125 and voice coil 126 are connected to produce a first subassembly. Another subassembly includes the front frame member 114 and annular diaphragm 104. Then the flange 132 of the intermediate frame member 113 can be affixed to the flange 133 thereby clamping the surround 153 to the frame. Next the flange 115 of the first subassembly attaches to the flange 131 with the radial arms 160 through 163 being aligned with and inserted into the channels 165 through 168. These channels are readily accessible from the front of the loudspeaker 100, as shown in FIG. 5. As specifically shown in FIG. 2, this orients the two conically shaped diaphragms so they diverge from the central opening 107 along the axis 101 in opposite directions. The process ends when the arms 160 through 163 are affixed to the channels 165 through 168 by epoxy or other adhesive or by any other process that will produce an attachment that will withstand the stresses introduced by normal operations of the loudspeaker 100 or acoustic transducer.

As will now be apparent, the construction of the loudspeaker 10 in FIG. 1 and the loudspeaker 100 in FIGS. 2 through 5, whether used as conventional loudspeakers or as other acoustic transducers, meets all of the objectives of this invention. Any acoustic transducer incorporating the various structural features of this invention will operate with good performance characteristics including an improved frequency response. In addition, such an acoustic transducer will avoid port resonances that might characterize acoustic transducers constructed in accordance with prior principles.

This invention has been described by disclosing two specific embodiments that are useful in loudspeaker applications. For these and other applications, the motion generator may take several forms. Alternate voice coil and bobbin arrangements could be substituted. Piezoelectric or purely mechanical devices could be substituted to provide the oscillating mechanical motion along an axis to move the diaphragms. The diaphragms 104 and 105 are shown as molded structures with conventional surrounds. Diaphragms of different configurations and manufactured by different processes could be substituted for the specifically disclosed diaphragm structures. Surrounds attach the diaphragms to the frame. Other structures might also perform the same function.

Thus, although this invention has been disclosed in terms of certain embodiments, it will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An acoustic transducer for generating acoustic waves along a transducer axis, said transducer comprising:

A) a frame extending along the transducer axis with a central opening therethrough on the axis, B) a motion generator connected to said frame for producing an oscillatory output motion along the transducer axis, C) an open diaphragm with an outer periphery and an inner periphery that defines a central opening on the axis and axially proximate the central frame opening, D) first and second flexible couplings attaching said open diaphragm inner and outer peripheries to said frame generally transverse to the transducer axis and spaced from said motion generator, E) a continuous diaphragm with an outer periphery, F) a third flexible coupling attaching said continuous diaphragm outer periphery to said frame generally transverse to the transducer axis and intermediate of and spaced from said open diaphragm and said motion generator, said continuous diaphragm being attached to said motion generator, and G) an axially rigid coupling between said continuous and open diaphragms whereby motion of said continuous diaphragm produced by said motion generator produces corresponding motion of said open diaphragm and wherein air intermediate said diaphragms displaced by said continuous diaphragm moves through the central opening of said open diaphragm.

2. An acoustic transducer as recited in claim 1 wherein said axially rigid coupling includes a first attachment for engaging said open diaphragm and a second attachment for engaging said continuous diaphragm.

3. An acoustic transducer as recited in claim 1 wherein said continuous diaphragm and said frame form a variable volume that opens to the central opening through said open diaphragm.

4. An acoustic transducer as recited in claim 1 wherein each of said diaphragms has a conical shape positioned to diverge in opposite directions from said open diaphragm central opening.

5. An acoustic transducer as recited in claim 4 wherein said motion generator comprises an electro-mechanical transducer for generating oscillatory motion along the transducer axis in response to alternating current signals.

6. An acoustic transducer as recited in claim 5 wherein said continuous diaphragm and said frame form a variable volume that opens to the central opening through said open diaphragm.

7. An acoustic transducer as recited in claim 6 wherein said axially rigid coupling includes a first attachment for engaging said open diaphragm proximate the central opening thereof and a second attachment for engaging said continuous diaphragm.

8. An acoustic transducer as recited in claim 4 wherein said motion generator comprises a magnet structure with an air gap and a coil disposed on a bobbin in the air gap to oscillate along the transducer axis in response to an alternating current applied to said coil, said bobbin being attached to said axially rigid coupling proximate said continuous diaphragm.

9. An acoustic transducer as recited in claim 7 wherein said frame has first, second and third axially displaced portions extending along the transducer axis from said magnet structure, said first portion supporting said magnet structure, said second portion supporting said continuous diaphragm and said third portion supporting said open diaphragm.

10. An acoustic transducer as recited in claim 9 wherein said continuous diaphragm and said second portion are spaced to define a variable volume that converges and opens to the central opening through said open diaphragm.

11. An acoustic transducer as recited in claim 4 wherein each of said flexible couplings circumscribes the corresponding periphery of said respective open and continuous diaphragms.

12. A loudspeaker for generating acoustic waves along a speaker axis, said loudspeaker comprising:

A) a frame extending along the loudspeaker axis with a central opening therethrough on the axis, B) a magnetic structure connected to the frame including a magnet with an air gap and a voice coil on a bobbin in the air gap whereby electrical signals applied to the voice coil produce oscillatory motion of the voice coil in the air gap along the loudspeaker axis, C) an annular diaphragm with an outer periphery and an inner periphery that defines a central opening on the loudspeaker axis and axially proximate the central frame opening, D) first and second flexible couplings circumscribing said annular diaphragm inner and outer peripheries and attached to said frame to position said annular diaphragm transversely to the loudspeaker axis and spaced from said magnet structure, E) a continuous diaphragm with an outer periphery, F) a third flexible coupling circumscribing said continuous diaphragm outer periphery and attached to said frame to position said continuous diaphragm transversely to the loudspeaker axis and intermediate of and spaced from said annular diaphragm and said magnet structure, said continuous diaphragm being connected to said bobbin, and G) an axially rigid coupling between said continuous and annular diaphragms whereby motion of said continuous diaphragm produced by said voice coil and bobbin produces corresponding motion of said annular diaphragm and wherein air intermediate said diaphragms displaced by said continuous diaphragm moves through the central opening of said annular diaphragm.

13. A loudspeaker as recited in claim 12 wherein said axially rigid coupling includes a first attachment for engaging said annular diaphragm proximate the central opening therethrough and a second attachment for engaging said continuous diaphragm.

14. A loudspeaker as recited in claim 12 wherein said continuous diaphragm and said frame form a variable volume that opens to the central opening through said annular diaphragm.

15. A loudspeaker as recited in claim 12 wherein each of said diaphragms has a conical shape positioned to diverge in along the loudspeaker axis in opposite directions from said annular diaphragm central opening.

16. A loudspeaker as recited in claim 12 wherein said continuous and annular diaphragms comprise a closed speaker cone and an annular speaker cone, respectively, each of said flexible couplings comprises a surround that attaches to the frame and a corresponding periphery of one of the speaker cones.

17. A loudspeaker as recited in claim 16 wherein said frame has first, second and third axially displaced portions extending along the loudspeaker axis from said magnet structure, said first portion supporting said magnet structure, said second portion supporting said continuous diaphragm speaker cone and said third portion support said annular diaphragm speaker cone.

18. A loudspeaker as recited in claim 17 wherein said continuous diaphragm speaker cone and said second portion are spaced to define a variable volume that converges and opens to the central opening through said annular diaphragm speaker cone.

19. A loudspeaker comprising a frame having a magnetic structure with an air gap and comprising a voice coil and a bobbin for oscillating on a speaker axis through the air gap in response to electrical signals, said loudspeaker additionally comprising:

A) a first speaker cone having an annular shape with an outer periphery attached to the frame and spaced from the magnetic structure, B) a second speaker cone with an outer periphery attached to the frame whereby said second speaker cone is intermediate the magnetic structure and said first speaker cone and is spaced from each of the magnetic structure and said first speaker cone, and C) an axially rigid coupling between said spaced first and second speaker cones connected to the bobbin whereby oscillation of the voice coil and the bobbin along the speaker axis produces corresponding motion of said first and second speaker cones.

20. A loudspeaker as recited in claim 19 wherein the air gap has a cylindrical shape and said coupling includes an axially extending cylindrical portion for carrying the voice coil in the air gap.

21. A loudspeaker as recited in claim 20 wherein said coupling includes a plurality of axially extending, radially displaced thin members affixed at one end to said cylindrical portion proximate one of the first and second speaker cones and that attach to the complementary portions of the other of said first and second speaker cones thereby to define a low-impedance air passage through said first speaker cone for air displaced by said speaker cone.

* * * * *